US009307315B2

(12) United States Patent
McKeough

(10) Patent No.: US 9,307,315 B2
(45) Date of Patent: Apr. 5, 2016

(54) WATERPROOF AUDIO AND STORAGE SYSTEM

(71) Applicant: C-Level Technology, LLC, Mandeville, LA (US)

(72) Inventor: Aeron McKeough, Mandeville, LA (US)

( * ) Notice: Subject to any disclaimer, the term of this patent is extended or adjusted under 35 U.S.C. 154(b) by 71 days.

(21) Appl. No.: 14/255,598

(22) Filed: Apr. 17, 2014

(65) Prior Publication Data

US 2014/0341413 A1 Nov. 20, 2014

Related U.S. Application Data

(60) Provisional application No. 61/813,525, filed on Apr. 18, 2013.

(51) Int. Cl.

| | |
|---|---|
| ***H04R 1/02*** | (2006.01) |
| ***H04R 1/44*** | (2006.01) |
| ***H04R 1/00*** | (2006.01) |

(52) U.S. Cl.

CPC .. *H04R 1/44* (2013.01); *H04R 1/00* (2013.01); *H04R 1/025* (2013.01); *H04R 2201/028* (2013.01); *H04R 2420/07* (2013.01)

(58) Field of Classification Search

CPC ..... H04R 2499/11; H04R 5/02
USPC ..... 381/334
See application file for complete search history.

(56) References Cited

U.S. PATENT DOCUMENTS

| | | | | |
|---|---|---|---|---|
| 4,489,770 | A | 12/1984 | Reich | |
| 4,562,590 | A | 12/1985 | DeLage | |
| 6,396,769 | B1 | 5/2002 | Polany | |
| 6,614,722 | B2 | 9/2003 | Polany | |
| 6,954,405 | B2 | 10/2005 | Polany | |
| 7,263,032 | B2 | 8/2007 | Polany | |
| 7,535,799 | B2 | 5/2009 | Polany | |
| 7,755,975 | B2 | 7/2010 | Pettersen | |
| 8,223,997 | B2 | 7/2012 | Wilson | |
| 2005/0185916 | A1* | 8/2005 | Jost | A45C 13/02 386/361 |
| 2008/0237939 | A1* | 10/2008 | McDonnough | A45C 13/02 264/500 |
| 2012/0250928 | A1* | 10/2012 | Pance | H04R 9/066 381/386 |
| 2014/0193017 | A1* | 7/2014 | Fortin | H04R 1/021 381/334 |

* cited by examiner

*Primary Examiner* — Simon King

(57) ABSTRACT

A portable and waterproof audio reproduction device is provided, comprising a case having a base and a lid defining an internal volume, and further including a seal between the base and the lid sufficient to prevent water from entering the internal volume when the lid is closed onto the base. The case includes control electronics within the internal volume, wherein the control electronics are adapted to receive an audio signal from an audio device located either inside the case or outside the case. The case also includes a battery, electrically connected to the control electronics. Surface transducers are electrically connected to the control electronics and operatively attached to an internal surface of the case, wherein the surface transducers are capable of receiving the audio signal from the audio device and causing vibration of the internal surface in response to the audio signal.

16 Claims, 10 Drawing Sheets

WATERPROOF AUDIO AND STORAGE SYSTEM

CROSS-REFERENCE TO RELATED APPLICATIONS

This application claims the benefit under 35 U.S.C. §119 (e) to provisional application Ser. No. 61/813,525, filed Apr. 18, 2013.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

1. Field of the Invention

The present invention relates to devices and methods for enabling sound reproduction through speakers contained within a waterproof enclosure, and more particularly to such devices and methods which employ surface transducers within the enclosure, and wherein the surface transducers are responsive to electronics residing within the enclosure.

2. Background Art

Modern electronics and communication technologies have enabled persons to have digital music with them virtually anywhere and at any time. The advent of various wireless networking protocols, such as Bluetooth®, allow music to be played wirelessly through a wide range of enabled devices. For example, digital music players, including the iPod®, and smart phones can send an audio signal to a car audio system or to a portable speaker unit.

However, there is often a desire to play music when the user engages in activities which may be environmentally injurious to the speakers. Typical situations in which music playback may not be possible are in wet areas, such as in a pool, the beach, boating activities, or during the rain. Most conventional speakers would be damaged by exposure to the elements in this way, or the use of AC-powered speakers may present a significant risk of electrocution. Several attempts have been made in the prior art to protect conventional speakers within enclosures that shield them from such environments. But, such attempts are either ineffective in protecting the speakers, or the protective enclosures themselves inhibit or degrade the quality of the sound that is produced.

When persons are in such environments, there is often a need to protect a wide array of personal items from becoming wet or lost, such as phones, keys, wallets, money, and the like. One solution is to place such items in a plastic bag that is held by the user, or secured nearby in a dry location. However, this can be an inconvenient and ineffective solution, due to misplacement or rupture of the bag.

Ideally, a music player should be capable of a number of key objectives: (1) withstanding the environmental conditions to which the user is exposed, (2) producing high quality sound reproduction at acceptable volume levels, (3) operating remotely based on audio signals provided wirelessly by the user's digital device, (4) responding to playback and volume controls from outside of a sealed enclosure, and (5) storing and protecting personal items of the user within the sealed enclosure. Such features would allow the user to take high-quality sound reproduction and personal items virtually anywhere.

SUMMARY OF THE INVENTION

A portable and waterproof audio reproduction device is provided, comprising a case having a base and a lid defining an internal volume, and further including a seal between the base and the lid sufficient to prevent water from entering the internal volume when the lid is closed onto the base. The case includes control electronics within the internal volume, wherein the control electronics are adapted to receive an audio signal from an audio device located either inside the case or outside the case. The case also includes an energy storage device, such as a battery, electrically connected to the control electronics. At least one surface transducer, and preferably two surface transducers, are electrically connected to the control electronics and operatively attached to an internal surface of the case, wherein the surface transducers are capable of receiving the audio signal from the audio device and causing vibration of the internal surface in response to the audio signal.

In a preferred embodiment, the control electronics comprise a printed circuit board having additional electronic features which are desirable to the operation of the device, such as a line-in input for receiving an audio signal, a charging input for charging the battery from an external power source, a power switch, a switch to activate an on-board wireless networking protocol such as Bluetooth®, an amplifier for amplifying the audio signal, and magnetically responsive switches for controlling playback and volume.

In a more preferred embodiment, the magnetically responsive switches are responsive to a magnetized stylus which can be used external to the case, and the case includes external icons corresponding to playback and volume control.

More preferably, a magnetic stylus holder is mounted to an external surface of the case for holding the magnetic stylus, allowing the user to use the stylus to control the device without opening the case in a wet environment.

In one embodiment, the case further includes a bottom tray positioned in the base, and wherein the bottom tray covers the control electronics.

In another embodiment, the case further includes a lid tray positioned in the lid, and wherein the lid tray covers the surface transducers.

In still another embodiment, the internal volume of the case includes at least one storage volume adapted to store selected items, and the storage volume may include foam elements adapted to protect the selected items in a customizable configuration.

The bottom tray may include a compartment for containment of the battery, and may further include a removable cover for the compartment.

The bottom tray may also include one or more buttons for interfacing with one or more switches on the control electronics, including a power switch and a wireless networking switch.

In the embodiments described herein, the case provides a waterproof seal when the case is closed, allowing the user to protect items stored within the internal storage volume. The internal control electronics receive power from the internal battery, and the amplifier provides an amplified audio signal to the surface transducers. The audio signal may be supplied by any common digital audio device (such as a smart phone or other electronic music player) residing within the case and plugged into a line-in port which communicates with the amplifier. Alternatively, the digital audio device may reside either inside or outside the case, and it may communicate with the amplifier through wireless networking protocol electronics present within the case, such as Bluetooth®. During operation, the surface transducers which are adhesively applied to an internal surface of the case cause vibration of the internal surface sufficient to produce sound corresponding to the audio signal. In one method of use, playback and volume control may be accomplished remotely and wirelessly by using the digital audio device itself. Alternatively, playback and volume control may be accomplished by using an external magnetic stylus in communication with magnetically responsive switches located on the control electronics, and corresponding to playback and volume control icons on the external surface of the case.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements.

DETAILED DESCRIPTION OF THE INVENTION

Before the subject invention is further described, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

In this specification and the appended claims, the singular forms "a," "an," and "the" include plural reference unless the context clearly dictates otherwise. Unless defined otherwise, all technical and scientific terms used herein have the same meaning as commonly understood to one of ordinary skill in the art to which this invention belongs.

Figure 2:
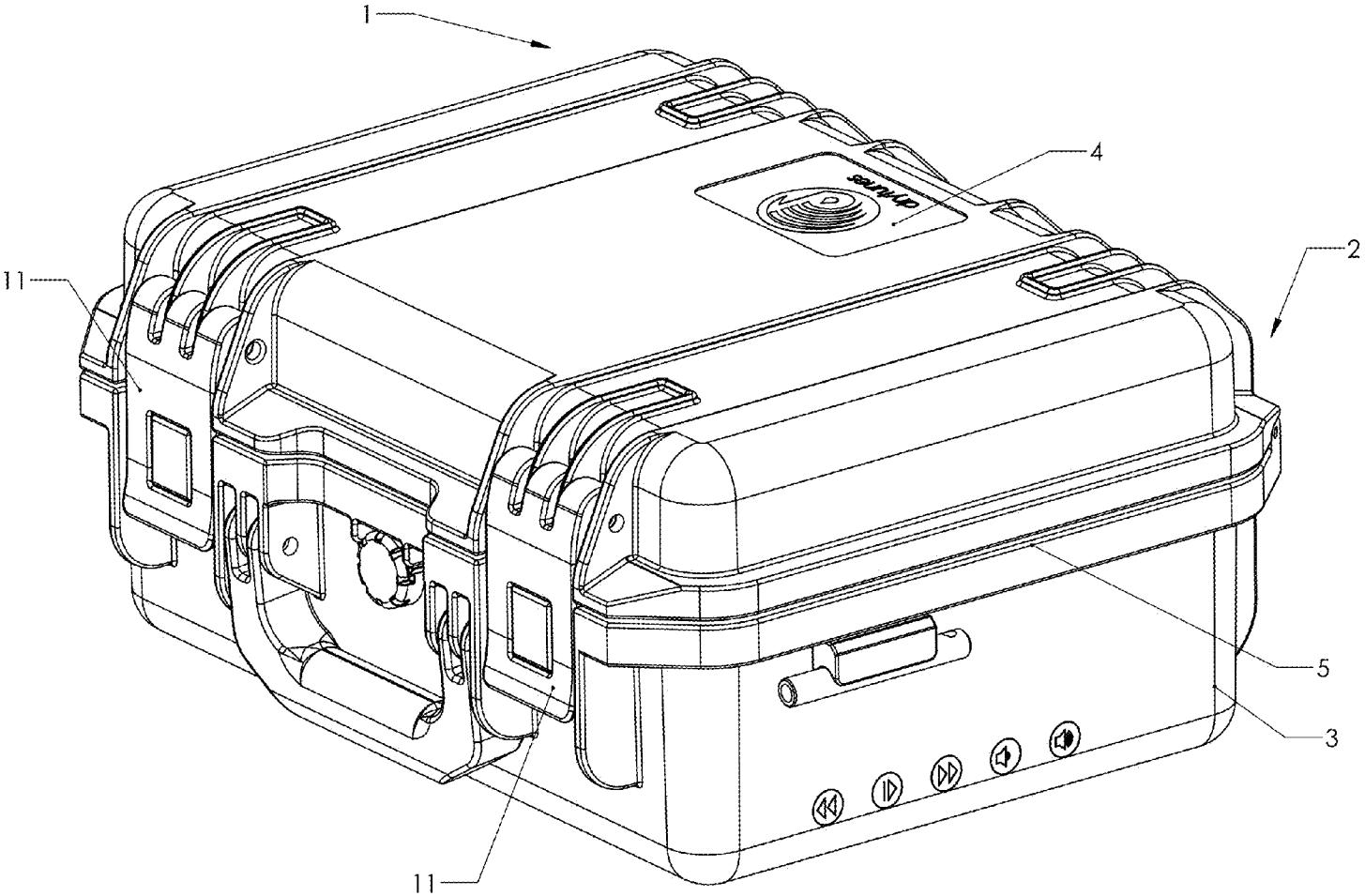
FIG. 2 shows a perspective view of the invention in a closed position.
Figure 3:
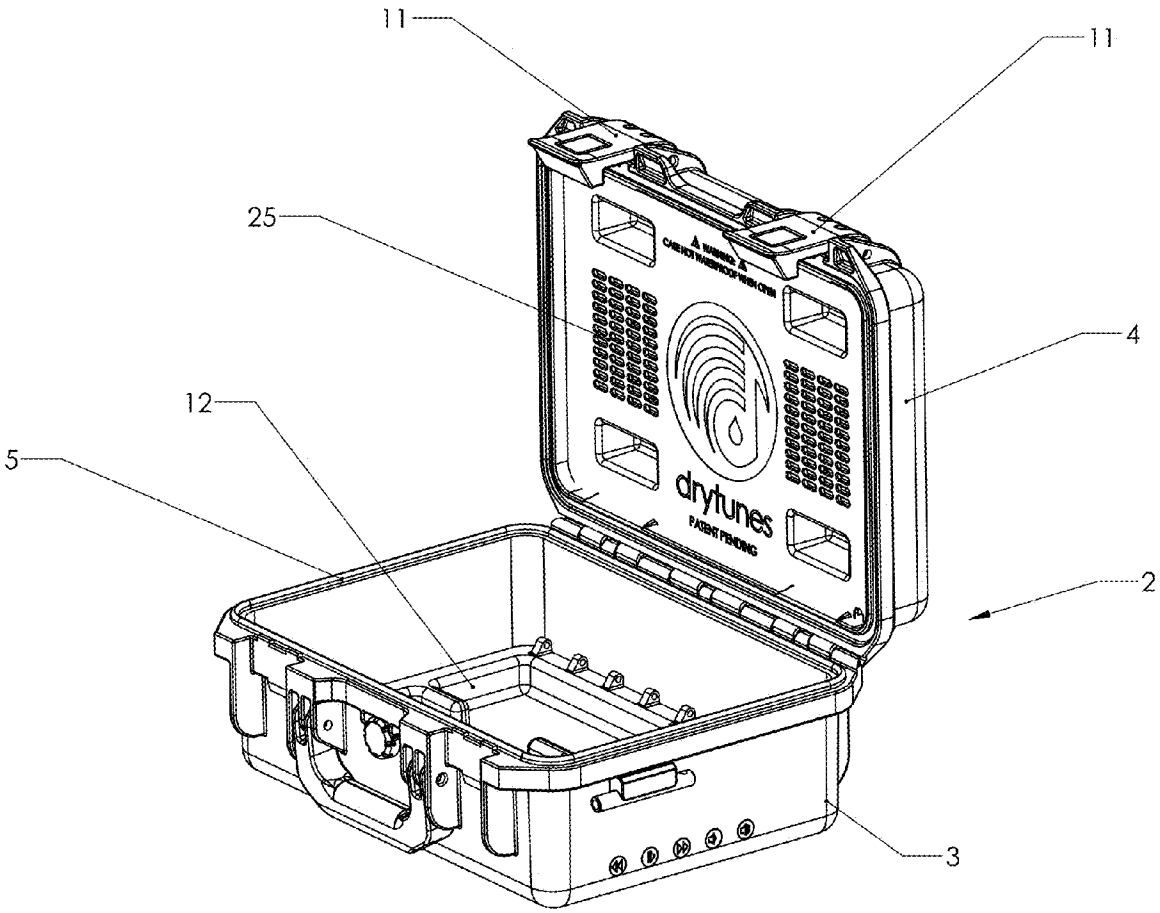
FIG. 3 shows a perspective view of the invention in an open and assembled configuration.
Figure 4:
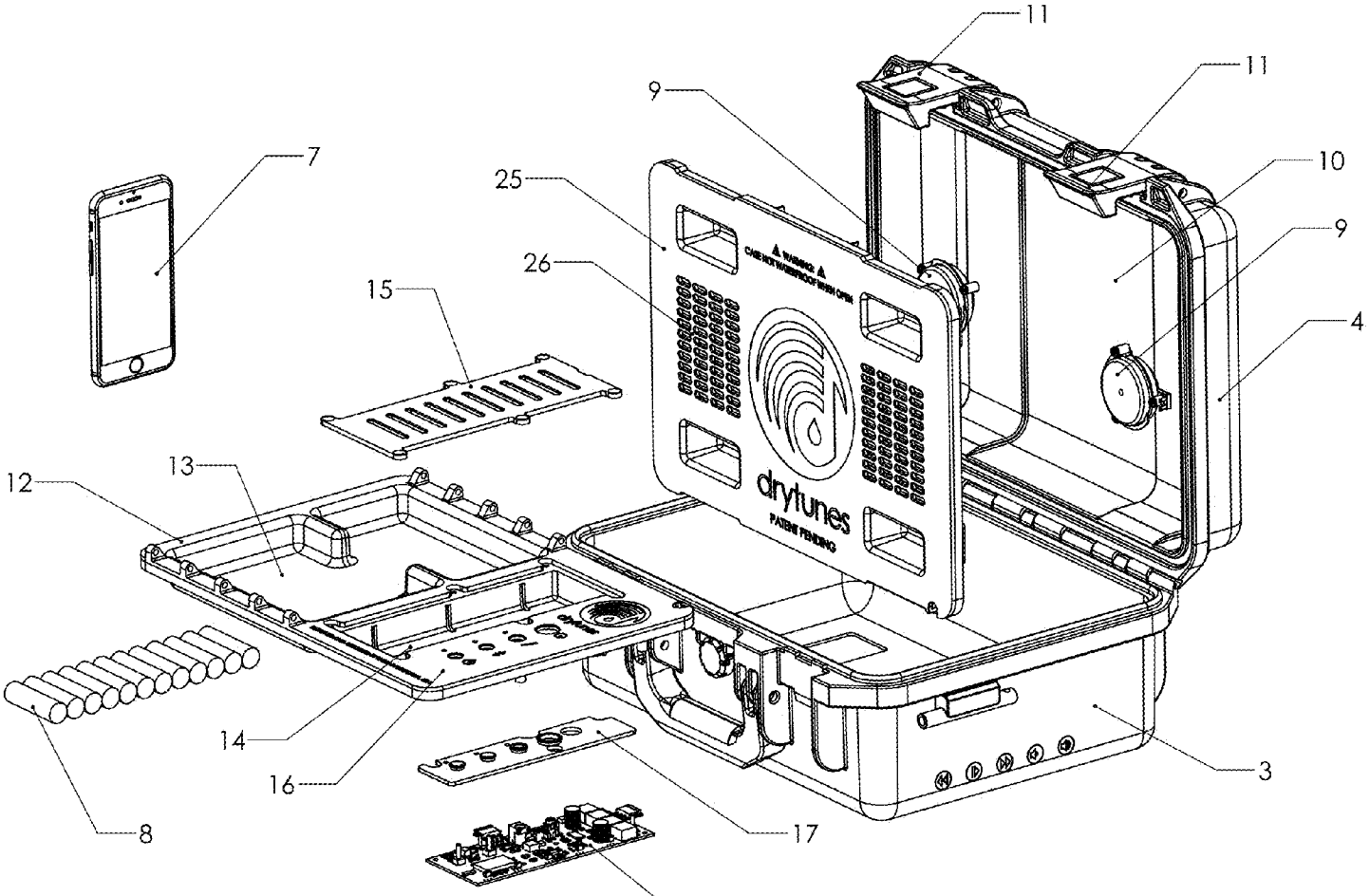
FIG. 4 shows an exploded view of the invention of FIG. 3 depicting various components in a preferred embodiment.

Referring now to the figures, a preferred embodiment of a portable and waterproof audio reproduction device 1 is shown in FIGS. 2-4, comprising a case 2 having a base 3 and a hinged lid 4 defining an internal volume, and further including a seal 5 between the base 3 and the lid 4 sufficient to prevent water from entering the internal volume when the lid 4 is closed onto the base 3 using latches 11. The case 2 includes control electronics 6 (such as a printed circuit board, or PCB) within the internal volume, wherein the control electronics 6 are adapted to receive an audio signal from an audio device 7 located either inside the case or outside the case 2. The case 2 also includes an energy storage device 8, such as a battery, electrically connected to the control electronics 6. At least one surface transducer 9, and preferably two surface transducers, are electrically connected to the control electronics 6 and operatively attached to an internal surface 10 of the case 2, wherein the surface transducers 9 are capable of receiving the audio signal from the audio device 7 and causing vibration of the internal surface 10 in response to the audio signal.

With respect to the battery 8, the battery should have sufficient capacity to retain an operable charge for several hours of continuous use. Consumers expect long battery life and light batteries. The energy density of lithium battery technologies is very favorable for this purpose, along with nickel-metal hydride (NiMH). However, a balance should be determined between a battery that is reasonable in size and cost, versus lowering the output power and/or the target runtime.

The case 2 is preferably a ruggedized and substantially rigid plastic case similar in structure and function to the Storm Case® manufactured by Pelican Products, Inc. A wide variety of case sizes and shapes can be used without departing from the spirit and scope of the present invention, as long as the case 2 establishes a watertight seal, and as long as the surface transducers 9 can cause at least one panel of the case 2 to vibrate sufficient to produce sound at an acceptable quality and volume level.

Figure 7:
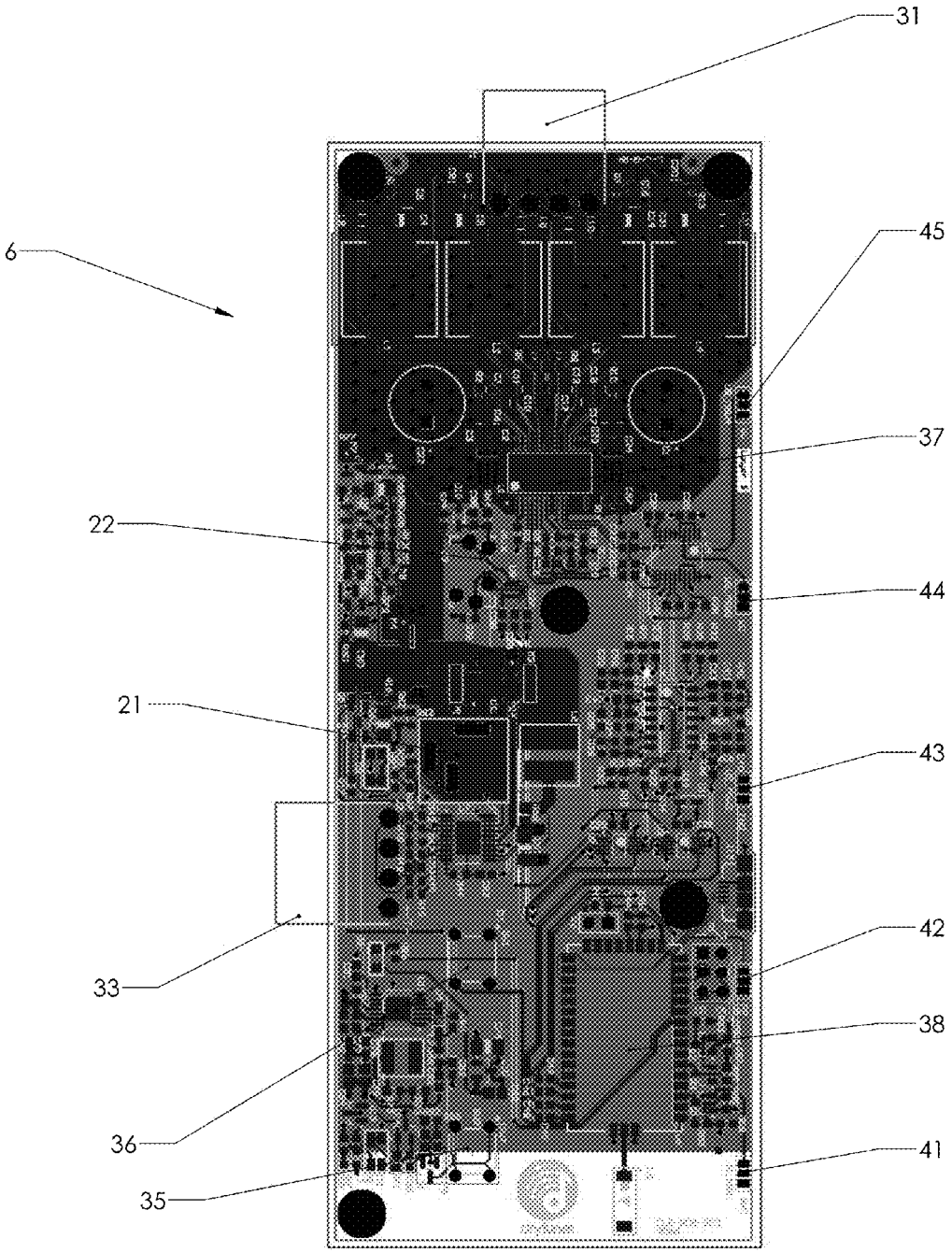
FIG. 7 shows a detailed view of the printed circuit board.

As shown in FIG. 7 and as further explained below, the control electronics 6 comprise a printed circuit board having additional electronic features which are desirable to the operation of the device 1, such as a line-in input 22 for receiving an audio signal, a charging input 21 for charging the battery 8 from an external power source, a power switch 19, a switch to activate an on-board wireless networking protocol 20 such as Bluetooth®, an amplifier 37 for amplifying the audio signal, and magnetically responsive switches 41-45 for controlling playback and volume.

The wireless networking functionality preferably conforms to a Bluetooth® protocol, although other wireless protocols may also be suitable. The Bluetooth® device should be a complete and self-contained FCC-qualified Bluetooth radio included on the PCB. The PCB also includes one or more on-board digital-to-analog converters (DAC) to generate an analog signal appropriate for the audio amplifier 37.

With respect to the audio amplifier 37, it is preferable that the amplifier have a power and efficiency which avoids the use of heat sinks or cooling fans. Although audio amplifiers are power intensive devices, a balance should be made between the degree of amplification and power consumption from the battery 8, all of which can be determined by persons of ordinary skill in the art.

Figure 5:
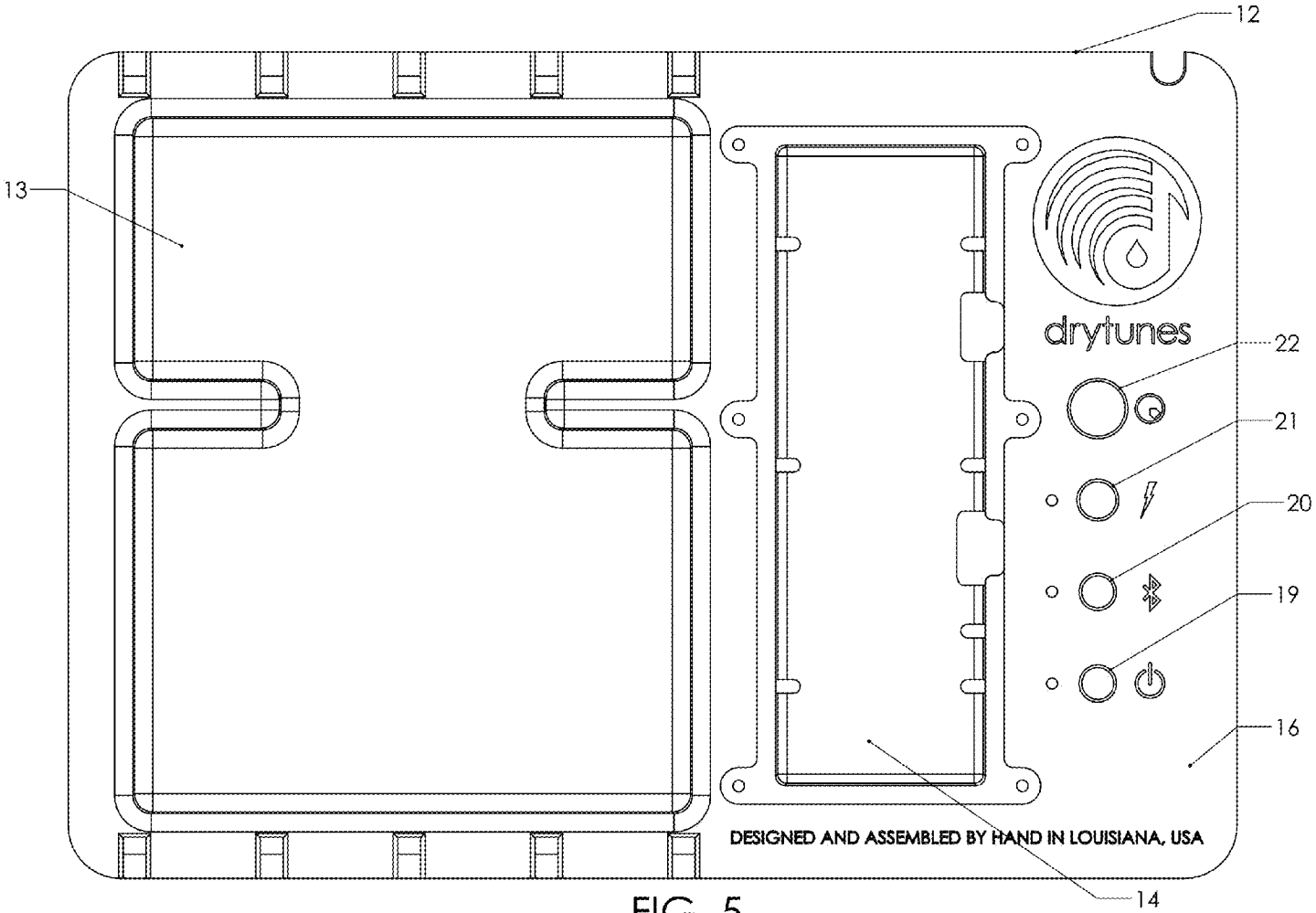
FIG. 5 shows a detailed view of the bottom tray.
Figure 6:
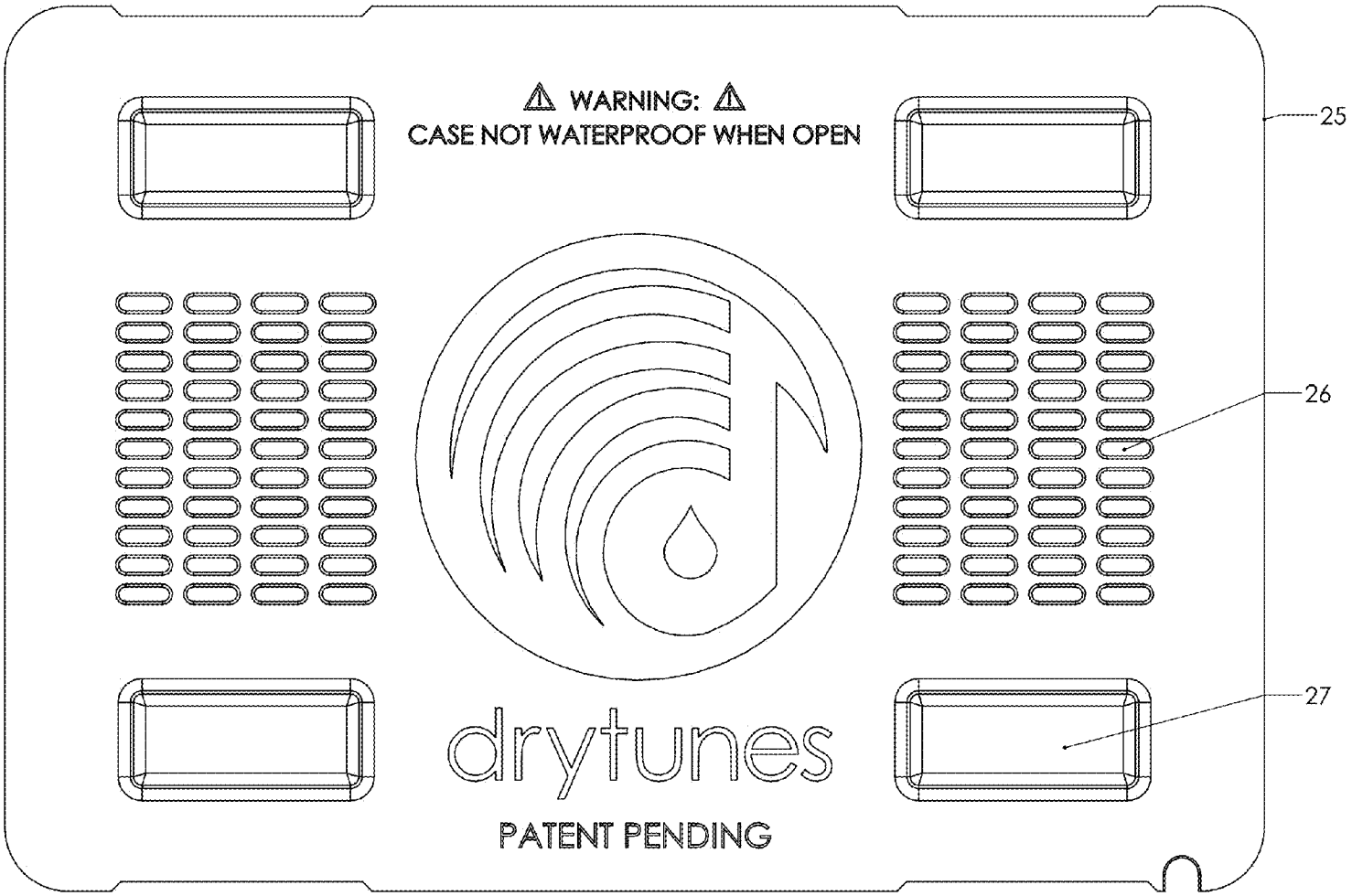
FIG. 6 shows a detailed view of the lid tray.

In order properly enclose the internal components of the device 1, and as shown in FIG. 4, the case 2 further includes a bottom tray 12 positioned in the base 3 which covers the control electronics 6. The bottom tray 12 is generally constructed from a plastic material and conforms to the internal surfaces of the base 3, and further includes stand-offs on its underside to provide room for the control electronics 6. The design of the bottom tray 12 is intended to meet a number of objectives. First, the bottom tray 12 includes a storage tray 13 for holding any personal items of the user, such as a phone, wallet, keys, and the like. The bottom tray 12 also includes a battery compartment 14 and a battery cover 15 attached to the bottom tray 12 by common fasteners. Finally, the bottom tray 12 includes a control panel 16 with cutouts for various functions to be described below. Immediately below the control panel 16 is a button panel 17 which includes buttons 18 corresponding to switches and ports on the control electronics 6. For example, as best shown in FIG. 5, the control panel includes a power button 19, a wireless networking (or Bluetooth®) button 20, a charging port 21, and a line-in (or AUX) port 22 (which is typically a 3.5 mm jack common for such purposes). With regard to assembly, once the control electronics 6 are affixed to the base 3, the button panel 17 is affixed to the underside of the control panel 16, and the bottom tray 12 is lowered into the base 3. Properly assembled, the buttons 19, 20 and ports 21, 22 should be directly above their corresponding electronic counterparts on the control electronics 6.

Similarly, the case 2 further includes a lid tray 25 positioned in the lid 4 which covers the surface transducers 9. The lid tray 25 is generally constructed from a plastic material and conforms to the internal surfaces of the lid 4, and further includes stand-offs 27 on its underside to provide room for the surface transducers 9 without touching them. Additional cutouts in the form of vents 26 are also preferably formed into the lid tray 25 to allow heat generated from the surface transducers 9 to dissipate. With regard to assembly, the surface transducers 9 are adhesively applied to the internal surface 10 of the lid 4, preferably using an adhesive similar in specifications to the DP-8005 structural plastic adhesive manufactured by the 3M Company, to ensure a complete and permanent bond. Once the surface transducers 9 are affixed, the lid tray 25 is installed into the lid 4.

Figure 1A:
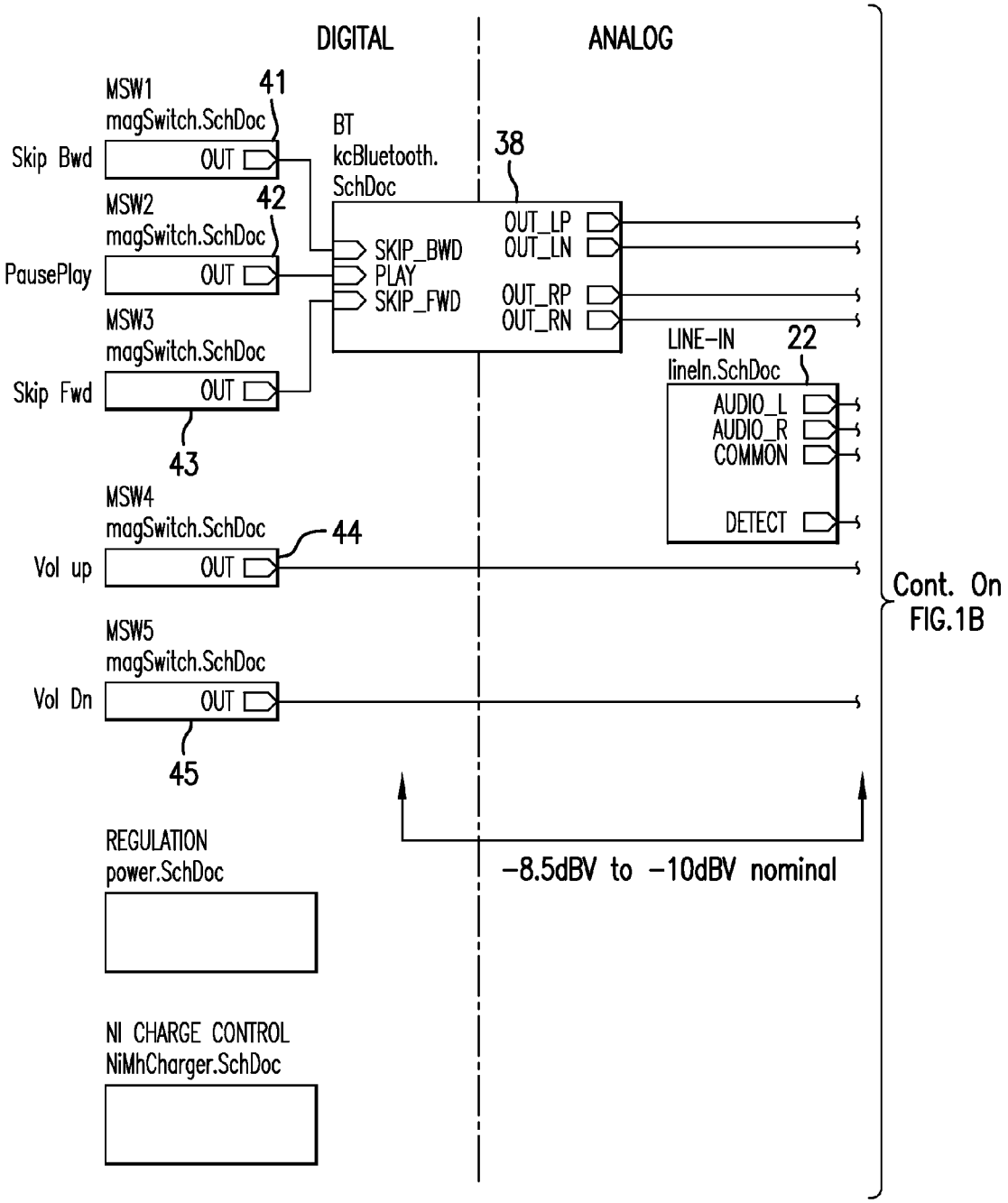
FIGS. 1A and 1B show a schematic diagram of key features and functionality on the control electronics in accordance with a preferred embodiment of the present invention.
Figure 1B:
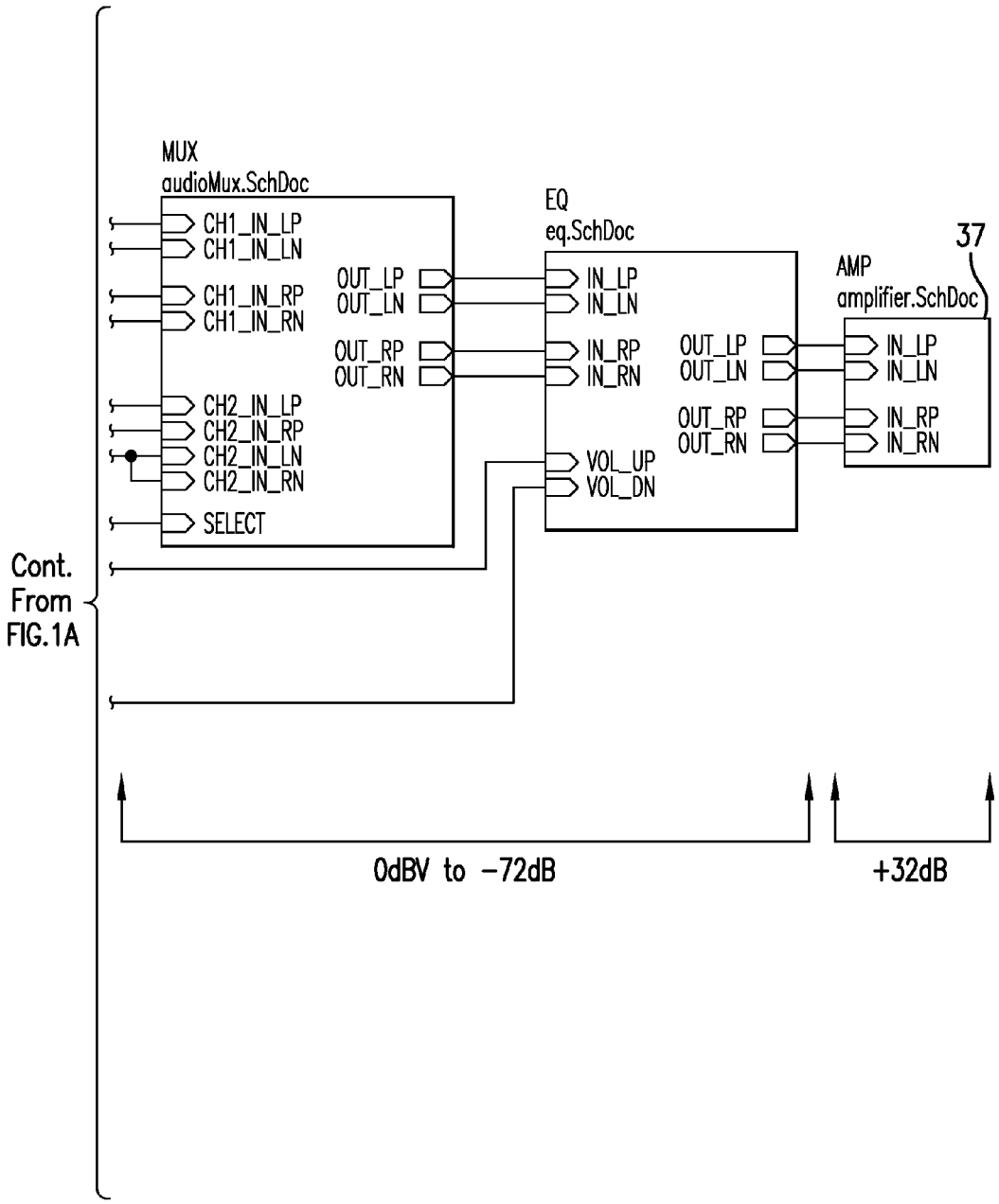
Figure 8:
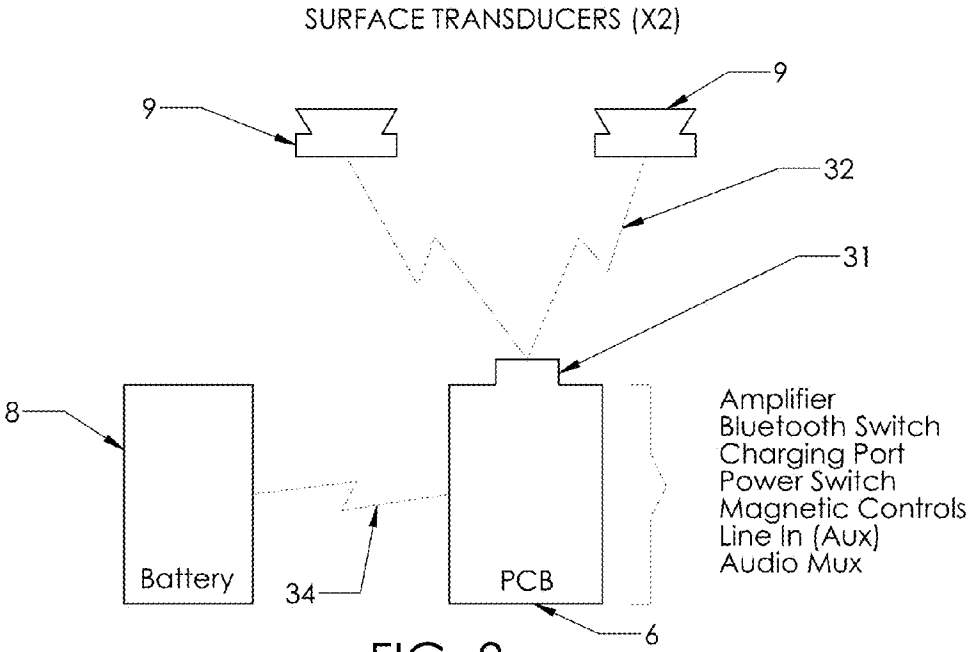
FIG. 8 shows a schematic view of electrical components and wiring.
Figure 9:
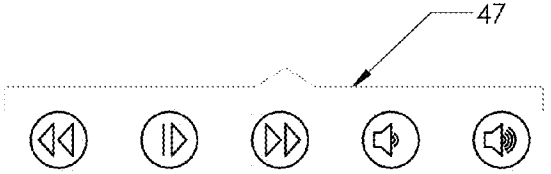
FIG. 9 shows a typical layout of icons for magnetic control of playback.

A preferred embodiment of the control electronics 6, such as a printed circuit board (PCB) is shown in FIG. 7. A more detailed schematic diagram of the major electronic features of the control electronics 6 is also shown in FIGS. 1A and 1B. A transducer connector 31 is present on one side of the PCB, from which a Y-shaped wiring harness 32 extends to connect to the surface transducers 9 as shown in the schematic diagram of FIG. 8. A battery connector 33 is present on another side of the PCB, from which a battery wire harness 34 extends to connect to the battery 8 as shown in FIG. 8. The control electronics 6 (PCB) further includes a power switch 35 (corresponding to power button 19), a wireless networking or Bluetooth® switch 36 (corresponding to Bluetooth® button 20 and Bluetooth® electronics 38), a charging port 21, and a line-in (or AUX) port 22. The power switch 35 enables or interrupts battery power, and the device may include additional processors for low power sleep behavior, or if unused for long periods of time. Indicators in the form of colored LED lights may include On/Off, battery status, and charging. Optionally, the PCB and control panel 16 may further include a USB port and related electronics so that the smart phone or audio device 7 can be charged from the battery 8.

Figure 10:
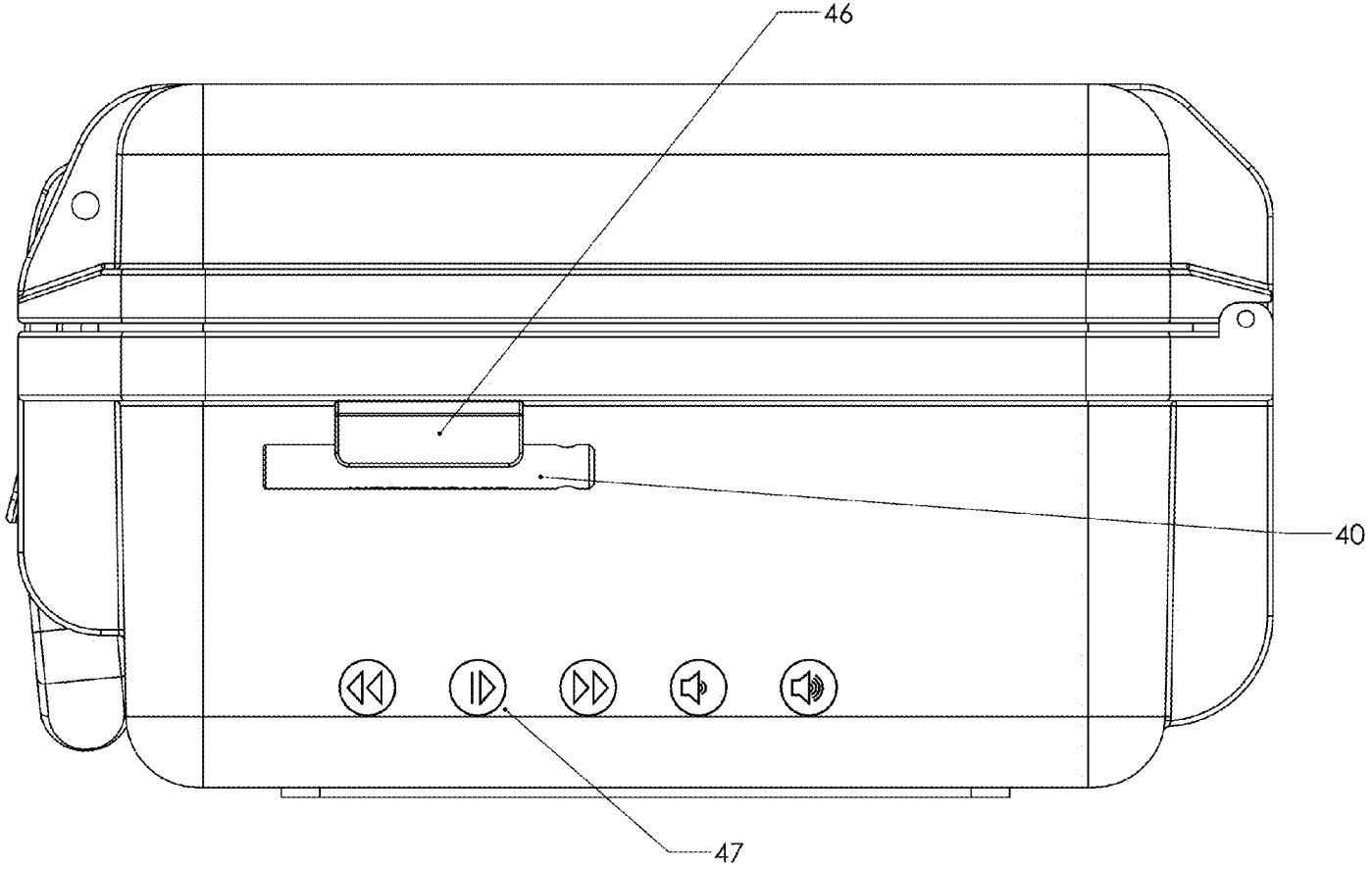
FIG. 10 shows a magnetic stylus and holder on the case.

The PCB also includes a number of magnetically responsive switches 41-45 which are responsive to a magnetized stylus 40 which can be used external to the case 2. In a preferred embodiment, the magnetic control switches correspond to rewind (or prior item in a playlist), play or pause, fast forward (or next item in a playlist), volume increase, and volume decrease. The case 2 includes a number of external icons 47 corresponding to playback and volume control, which may be laser etched onto the case exterior in locations proximate to their respective switches 41-45, as shown more clearly in FIG. 10. A magnetic stylus holder 46 is mounted to an external surface of the case 2 for holding the magnetic stylus 40 (either by physically gripping the stylus 40 or by magnetic means), allowing the user to use the stylus 40 to control the device without opening the case 2 in a wet environment.

With respect to the storage volume of the case 2, the storage volume may include foam elements adapted to protect the selected items in a customizable configuration.

In addition to the technical description of the present invention, the following are some common scenarios of how the invention might be used while engaging in various activities. For example, the user may wish to use the device in a pool by playing music from the user's smart phone 7. Prior to entering the pool, and in a dry environment, the user opens the case 2, and places any personal items into the storage volume. The device is powered on using the PWR switch, and the smart phone 7 is connected to the device by inserting one end of a data cable into the smart phone 7, and the other end of the data cable into the AUX (or line-in) port 22 on the device. The user then selects a song or playlist from the smart phone 7, and hits the play button on the smart phone 7, which causes the surface transducers 9 to produce sound through the case panel 10. The smart phone 7 is then placed into the storage volume, and the case 2 is securely closed. The device can then safely be placed into the pool, preferably with the sound producing panel 10 facing upward. At any time, the user can remove the magnetic stylus 40 from the stylus mount 46, and select any of the playback and volume controls 47 as desired.

Alternatively, the user can choose to leave the smart phone 7 out of the device, and instead control the music wirelessly from a dry location. In this scenario, the user would simply turn on the Bluetooth® switch, and allow the proper communication pairing to take place with the smart phone 7. Once the pairing is complete, the device can be closed and placed into the pool. As long as the user is within the operational range of the Bluetooth® electronics 38, music playback and volume control can be achieved from a dry location. If desired, the smart phone 7 can also be placed into the case 2 and allowed to communicate via Bluetooth® as well, as an alternative to using a data cable and the AUX port 22.

The interior volume of the case and the placement and protection of electrical components should account for occasional opening of the case during unfavorable conditions, e.g. wind, rain, dust, splashing, etc., without impairment of operation or damage to such components. The case itself should be sufficiently rugged to withstand dropping from reasonable heights, such as from vehicles interiors or from furniture or other locations where the device may be located. Likewise, placement and securing of electrical components should account for these possible dynamic stresses without damage. Similarly, the case must be capable of preventing damage to the components during full sunlight and high temperatures typically encountered in beach and pool environments.

All references cited in this specification are herein incorporated by reference as though each reference was specifically and individually indicated to be incorporated by reference. The citation of any reference is for its disclosure prior to the filing date and should not be construed as an admission that the present invention is not entitled to antedate such reference by virtue of prior invention.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

What is claimed is:

1. A waterproof audio reproduction device, comprising:

(a) a case having a base and a lid defining an internal volume, and further including a seal between the base and the lid sufficient to prevent water from entering the internal volume when the lid is closed onto the base;

(b) control electronics within the internal volume, wherein the control electronics are adapted to receive an audio signal from an audio device;

(c) an energy storage device electrically connected to the control electronics;

(d) at least one surface transducer electrically connected to the control electronics and operatively attached to an internal surface of the case, wherein the surface transducer is capable of receiving the audio signal from the audio device and causing vibration of the internal surface in response to the audio signal; and a bottom tray positioned in the base, wherein the bottom tray covers the control electronics and further includes a compartment for containment of the energy storage device, and a removable cover for the compartment.

2. The device of claim 1, wherein the control electronics comprise a printed circuit board.

3. The device of claim 1, wherein the control electronics include a power supply.

4. The device of claim 1, wherein the control electronics include an audio signal amplifier.

5. The device of claim 1, wherein the control electronics include a wireless networking device capable of receiving the audio signal.

6. The device of claim 1, wherein the control electronics include a charging port adapted to receive power from an external source sufficient to charge the energy storage device.

7. The device of claim 1, wherein the energy storage device is a battery.

8. The device of claim 1, wherein the control electronics include magnetic control switches, and wherein the magnetic control switches are responsive to a magnetized stylus external to the case.

9. The device of claim 8, wherein the magnetic control switches include controls for playback and volume control, and wherein the case includes external icons corresponding to playback and volume control.

10. The device of claim 8, further including a magnetic stylus holder mounted to an external surface of the case.

11. The device of claim 1, wherein the surface transducer is adhesively attached to the internal surface of the case.

12. The device of claim 1, wherein the case further includes a lid tray positioned in the lid, and wherein the lid tray covers the surface transducer.

13. The device of claim 1, wherein the internal volume of the case includes at least one storage volume adapted to store selected items.

14. The device of claim 13, wherein the storage volume includes foam elements adapted to protect the selected items.

15. The device of claim 1, wherein the bottom tray includes one or more buttons for interfacing with one or more switches on the control electronics.

16. The device of claim 1, wherein the control electronics includes an input port for receiving the audio signal.

* * * * *